US009644496B2

(12) United States Patent
Lopez-Parra et al.

(10) Patent No.: US 9,644,496 B2
(45) Date of Patent: May 9, 2017

(54) RADIAL DIFFUSER EXHAUST SYSTEM

(71) Applicant: General Electric Company, Schenectady, NY (US)

(72) Inventors: Fernando Lopez-Parra, Mazowieckie (PL); Balakrishnan Ponnuraj, Sugarland, TX (US); Przemyslaw Drezek, Mazowieckie (PL); Mehdi Milani Baladi, Cincinnati, OH (US); Ravinder Yerram, Houston, TX (US); Donald Gordon Laing, Houston, TX (US)

(73) Assignee: General Electric Company, Schenectady, NY (US)

( * ) Notice: Subject to any disclaimer, the term of this patent is extended or adjusted under 35 U.S.C. 154(b) by 1069 days.

(21) Appl. No.: 13/798,614

(22) Filed: Mar. 13, 2013

(65) Prior Publication Data

US 2014/0271168 A1 Sep. 18, 2014

(51) Int. Cl.
*F01D 25/30* (2006.01)

(52) U.S. Cl.
CPC ..... *F01D 25/30* (2013.01)

(58) Field of Classification Search
CPC ..... F01D 25/30; F04D 29/44; F04D 29/441; F04D 29/444; F04D 29/54; F04D 29/541; F04D 29/542; F04D 29/545
USPC ..... 415/207, 211.2
See application file for complete search history.

(56) References Cited

U.S. PATENT DOCUMENTS

| | | | | |
|---|---|---|---|---|
| 4,431,374 | A | 2/1984 | Benstein et al. | |
| 5,203,674 | A | 4/1993 | Vinciguerra | |
| 5,257,906 | A | 11/1993 | Gray et al. | |
| 5,704,211 | A | 1/1998 | Hatfield | |
| 6,227,696 | B1 | 5/2001 | Duchnowski et al. | |
| 7,934,904 | B2 | 5/2011 | Demiraydin et al. | |
| 2002/0127100 | A1* | 9/2002 | Kreitmeier | F01D 25/30 415/211.2 |
| 2005/0044859 | A1 | 3/2005 | Rybarczyk et al. | |
| 2009/0123277 | A1 | 5/2009 | Dalsania et al. | |

(Continued)

FOREIGN PATENT DOCUMENTS

| | | | |
|---|---|---|---|
| DE | 10255389 | A1 | 6/2004 |
| EP | 1178183 | A2 | 2/2002 |

(Continued)

OTHER PUBLICATIONS

PCT Search Report and Written Opinion dated Apr. 8, 2014 issued in connection with corresponding PCT Patent Application No. PCT/US2014/013703.

(Continued)

*Primary Examiner* — Thomas Denion
*Assistant Examiner* — Mickey France
(74) *Attorney, Agent, or Firm* — Sutherland Asbill & Brennan LLP

(57) ABSTRACT

The present application provides a radial diffuser exhaust system for use with a gas turbine engine. The radial diffuser exhaust system may include a radial diffuser positioned within an asymmetric exhaust collector. The asymmetric exhaust collector may include a closed end chamber and an exhaust end chamber. The closed end chamber may have a first size, the exhaust end chamber may have a second size, and the first size may be smaller than the second size.

7 Claims, 3 Drawing Sheets

(56) References Cited

U.S. PATENT DOCUMENTS

| | | | | |
|---|---|---|---|---|
| 2011/0088398 | A1 | 4/2011 | Subbarao et al. | |
| 2011/0162369 | A1* | 7/2011 | Myoren | F01D 25/30 60/722 |
| 2012/0034064 | A1* | 2/2012 | Nanda | F01D 25/30 415/1 |
| 2012/0121404 | A1 | 5/2012 | Neeli et al. | |
| 2012/0198810 | A1 | 8/2012 | Ansari et al. | |
| 2014/0047813 | A1* | 2/2014 | Frailich | F01D 25/30 60/39.5 |

FOREIGN PATENT DOCUMENTS

| | | | |
|---|---|---|---|
| EP | 2378077 | A2 | 10/2011 |
| FR | 2757210 | A1 | 6/1998 |
| GB | 2440343 | A | 1/2008 |

OTHER PUBLICATIONS

U.S. Appl. No. 12/343,021, Jan. 4, 2012, Subramaniyan, et al.
U.S. Appl. No. 13/288,057, Nov. 3, 2011, Gustafson, et al.

* cited by examiner

RADIAL DIFFUSER EXHAUST SYSTEM

TECHNICAL FIELD

The present application and resultant patent relate generally to gas turbine engines and more particularly relate to a gas turbine engine with a radial diffuser exhaust system having an enlarged expansion zone upstream of the support struts, diffuser guides with deflector lips, and an asymmetric exhaust collector.

BACKGROUND OF THE INVENTION

During normal operation of a gas turbine engine, one of the main aerodynamic challenges involves the efficient discharge of the high momentum combustion gas flow exiting the last stage of the turbine. Although it may be aerodynamically beneficial to use a horizontal exhaust configuration, such an axial exhaust may be impractical due to the overall footprint implications. Given such, it is standard practice to use a vertical and side mounted exhaust stacks that radially turns the combustion gas flow from an axial turbine. Specifically, a radial diffuser may be used to direct the combustion gas flow in a radial direction. The radial diffuser generally includes a number of struts mounted onto an inner diffuser guide and enclosed by an outer diffuser guide. The radial diffuser converts the kinetic energy of the combustion gas flow exiting the last stage of the turbine into potential energy in the form of increased static pressure. Increasing the overall static pressure recovery tends to increase the overall performance and efficiency of the gas turbine engine.

There is thus a desire for an improved diffuser design and an improved exhaust system for use with a gas turbine engine. Such an improved diffuser and exhaust system may provide enhanced aerodynamic performance and efficiency while reducing the overall axial length of the gas turbine engine as a whole. In addition, improvements to aero performance of exhaust systems traditionally has been linked with lower noise emissions, hence similar results may be expected from a radial exhaust diffuser as compared to a conventional axial configuration.

SUMMARY OF THE INVENTION

The present application and the resultant patent thus provide a radial diffuser exhaust system for use with a gas turbine engine. The radial diffuser exhaust system may include a radial diffuser positioned within an asymmetric exhaust collector. The asymmetric exhaust collector may include a closed end chamber and an exhaust end chamber. The closed end chamber may have a first size, the exhaust end chamber may have a second size, and the first size may be smaller than the second size.

The present application and the resultant patent further provide a radial diffuser exhaust system for use with a gas turbine engine. The radial diffuser exhaust system may include a radial diffuser positioned asymmetrically within an exhaust collector. The radial diffuser may include an upper diffuser guide. The upper diffuser guide may include an upstream expansion angle, a downstream expansion angle, an upper deflector lip with a slanted configuration, and a lower deflector lip.

The present application and the resultant patent further provide a radial diffuser exhaust system for use with a gas turbine engine. The radial diffuser exhaust system may include a radial diffuser positioned within an asymmetric exhaust collector. The radial diffuser may include an upper diffuser guide. The upper diffuser guide may include an upstream expansion angle and a downstream expansion angle. The upstream expansion angle may be larger than the downstream expansion angle.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
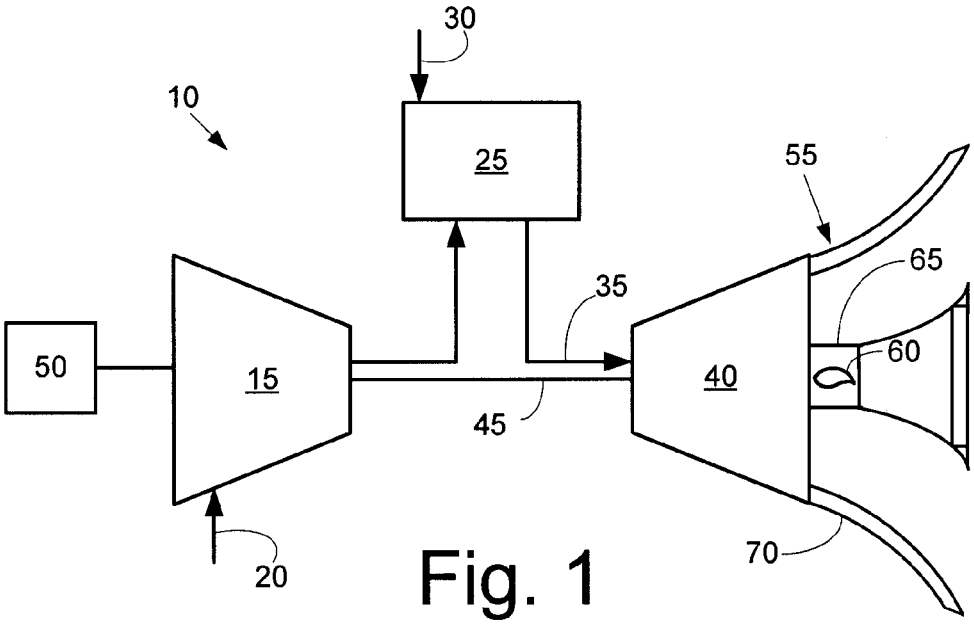
FIG. 1 is a schematic diagram of a gas turbine engine showing a compressor, a combustor, a turbine, and a diffuser.

Referring now to the drawings, in which like numerals refer to like elements throughout the several views, FIG. 1 shows a schematic diagram of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, liquid fuels, various types of syngas, and/or other types of fuels and combinations thereof. The gas turbine engine 10 may be any one of a number of different gas turbine engines offered by General Electric Company of Schenectady, New York, including, but not limited to, those such as a 7 or a 9 series heavy duty gas turbine engine, the GE Aero Derivatives engines, and the like. The gas turbine engine 10 may have different configurations and may use other types of components. Other types of gas turbine engines also may be used herein. Multiple gas turbine engines, other types of turbines, and other types of power generation equipment also may be used herein together.

The gas turbine engine 10 also may include a radial diffuser 55. The radial diffuser 55 may be positioned downstream of the turbine 40. As described above, the radial diffuser 55 may include a number of struts 60 mounted on an inner diffuser guide 65 and enclosed within an outer diffuser guide 70. The radial diffuser 55 turns the flow of combustion gases 35 in a radial direction. Other types of diffusers may be used. Other components and other configurations may be used herein.

Figure 2:
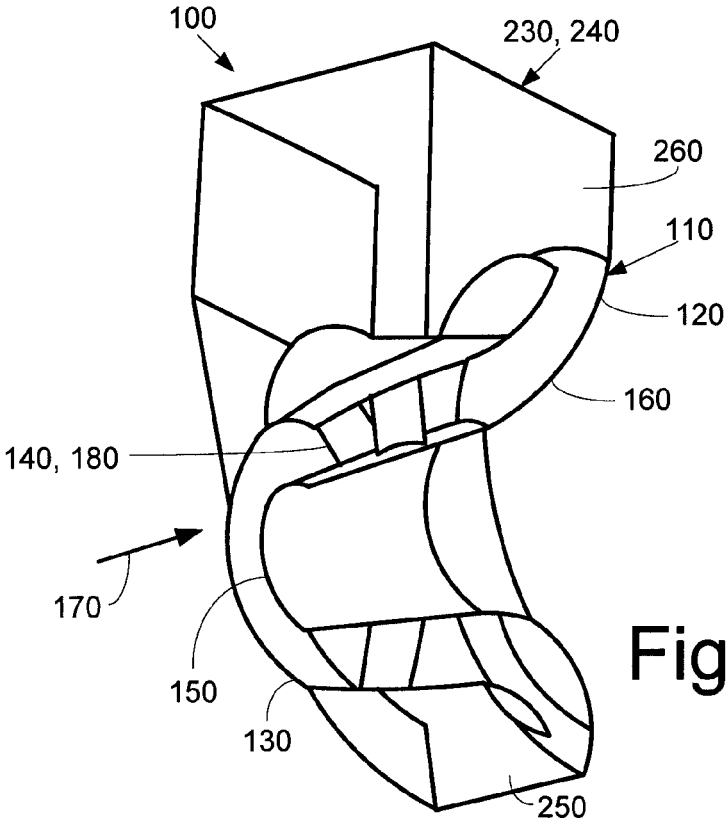
FIG. 2 is a sectional view of a radial diffuser exhaust system as may be described herein.
Figure 3:
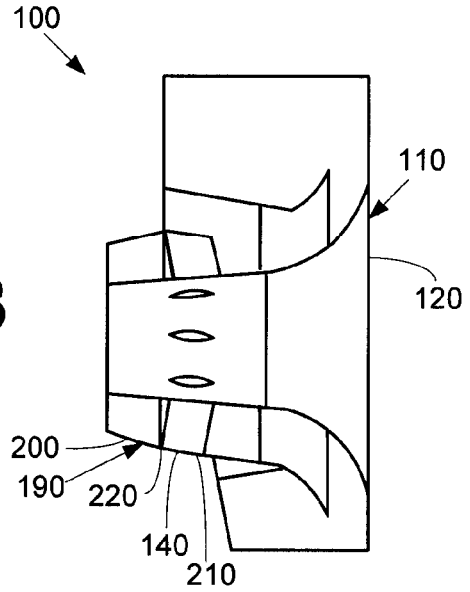
FIG. 3 is a partial side sectional view of the radial diffuser exhaust system of FIG. 2.

FIG. 2 and FIG. 3 show an example of a radial diffuser exhaust system 100 as may be described herein. The radial diffuser exhaust system 100 may include a radial diffuser 110. Similar to that described above, the radial diffuser 110 may include an inner diffuser guide 120, an outer diffuser guide 130, and a number of diffuser support struts 140 positioned therebetween. The inner diffuser guide 120 and the outer diffuser guide 130 both may have a conical section 150 leading to a downstream radial guide section 160. The inner diffuser guide 120 and the outer diffuser guide 130 define a flow path 170 therebetween. The flow path 170 may increase in area in the downstream direction. The radial diffuser 110 may have any size, shape, or configuration. Other components and other configurations may be used herein.

The radial diffuser 110 may have any number of the diffuser support struts 140. The support struts 140 may have an aerodynamic, airfoil-like shape 180 or a similar configuration. The support struts 140 may be positioned between the conical sections 150 of the inner diffuser guide 120 and the outer diffuser guide 130. Other components and other configurations may be used herein.

The outer diffuser guide 130 may include a kink 190 just upstream of the support struts 140. Specifically, the outer diffuser guide 130 may include an upstream expansion angle 200 upstream of the support struts 140 and a downstream expansion angle 210 downstream of a leading edge 220 of the support struts 140 with the kink 190 being the apex in-between. The upstream expansion angle 200 may be more than about twenty-five percent (25%) larger than the downstream expansion angle 210. The ratio of the upstream expansion angle 200 to the downstream expansion angle 210, as well as the axial length of the sections, may vary with the downstream design of the radial diffuser 110, the aerodynamic and thermodynamic characteristics of the flow including velocity, swirl, temperature, and pressure, as well other types of operational parameters. Other angles also may be used herein. Other components and other configurations may be used herein.

The radial diffuser exhaust system 100 also may include an exhaust collector 230. The radial diffuser 110 may be positioned within the exhaust collector 230. In this example, the exhaust collector 230 may be an asymmetric exhaust collector 240. The asymmetric exhaust collector 240 may include a closed end chamber 250 on one end thereof and an exhaust end chamber 260 on the other end. The closed end chamber 250 may be smaller than the exhaust end chamber 260. The ratio of the size of the closed end chamber 250 to the size of the exhaust end chamber 260 may depend upon the flow rate, total pressure, temperature, the cross-sectional area of the exhaust stack, and other types of operational parameters. By way of example, the axial length of the closed end chamber 250 may be more than about thirty percent (30%) shorter or smaller than the exhaust end chamber 260.

In use, the larger upstream expansion angle 200 positioned about the kink 190 in the outer diffuser guide 130 allows for a more aggressive expansion of the combustion gas flow 35 upstream of the support struts 140 with related slower expansion downstream thereof. The use of the differing expansion angles 200, 210 thus provides an improvement in static pressure recovery. Flow impingement on the leading edge 220 of the support struts 140 may remove part of the kinetic energy of the combustion gas flow 35. The larger upstream expansion angle 200 allows for a larger radius to be used in the support struts 140 so as to reduce the effective blockage and allow a better recovery of static pressure. The kink 190 also allows for a shorter axial length of the overall radial diffuser exhaust system 100.

The larger upstream expansion angle 200 is allowed because the support struts 140 may cause local deceleration and a static pressure increase so as to prevent flow separation from the outer diffuser guide 130. As such, the upstream expansion angle 200 may be synchronized with the blockage of the support struts 140, the operating engine mass flow rate, and the back pressure generated by the sharp turning of the flow about the closed end chamber 250. The larger upstream expansion angle 200 is placed at an upstream end of the outer diffuser guide 130 because of a strong boundary layer allows a more aggressive angle without separation for greater pressure recovery.

In order to reduce this back pressure at the closed end chamber 250, the asymmetric design of the closed end chamber 250 and the exhaust end chamber 260 may prevent the formation of large vortices so as to assist in achieving a smoother pressure recovery in the combustion gas flow 35. The formation of such vortices may be a primary cause of flow separation. The asymmetric exhaust chamber 240 thus provides enhanced aerodynamic performance while reducing the overall length of the radial diffuser exhaust system 100. The use of the kink 190 and the asymmetric exhaust chamber 240 thus may provide improvements in overall diffuser aerodynamic efficiency and overall engine performance.

Figure 4:
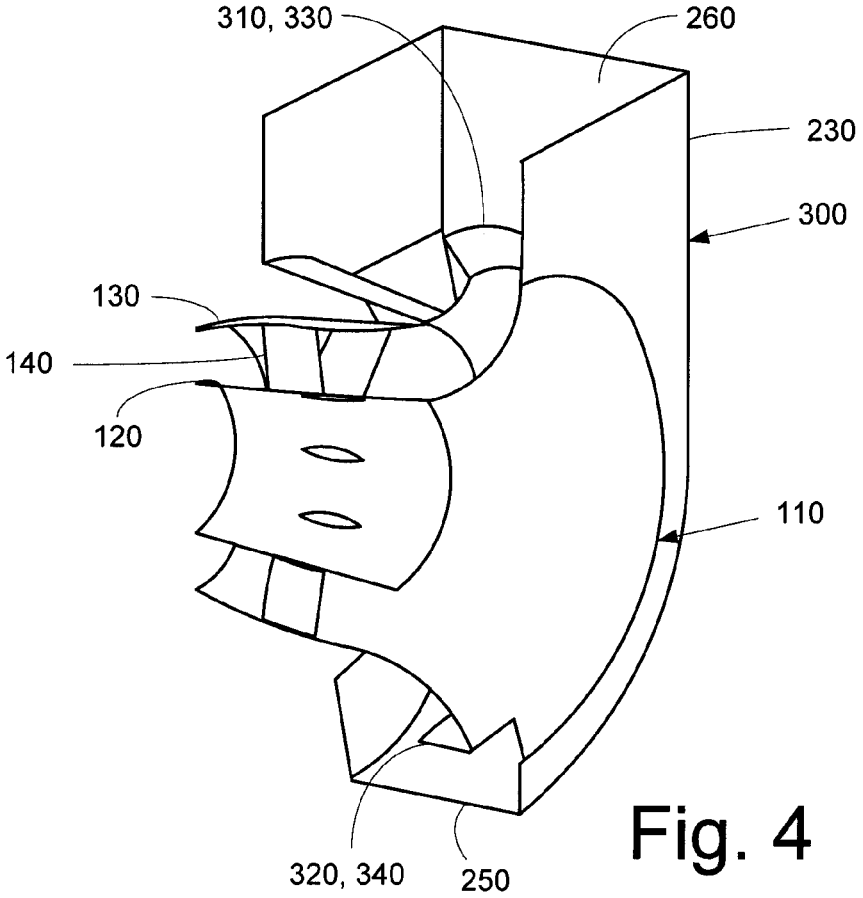
FIG. 4 is a sectional view of a further embodiment of a radial diffuser exhaust system as may be described herein.
Figure 5:
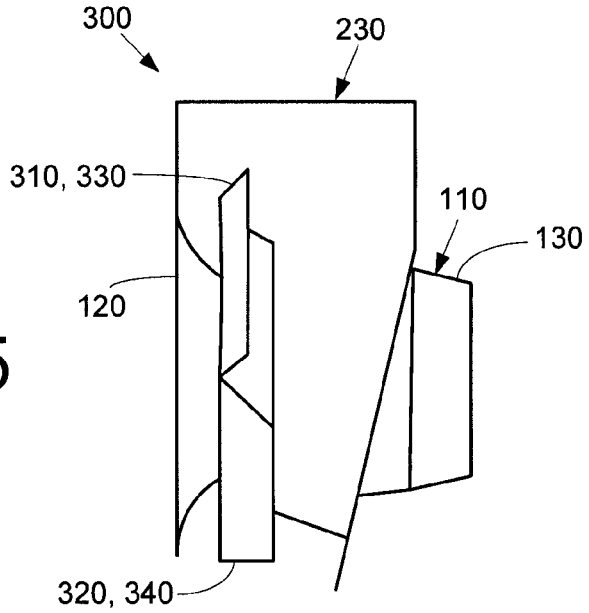
FIG. 5 is a partial side sectional view of the radial diffuser exhaust system of FIG. 4.
Figure 6:
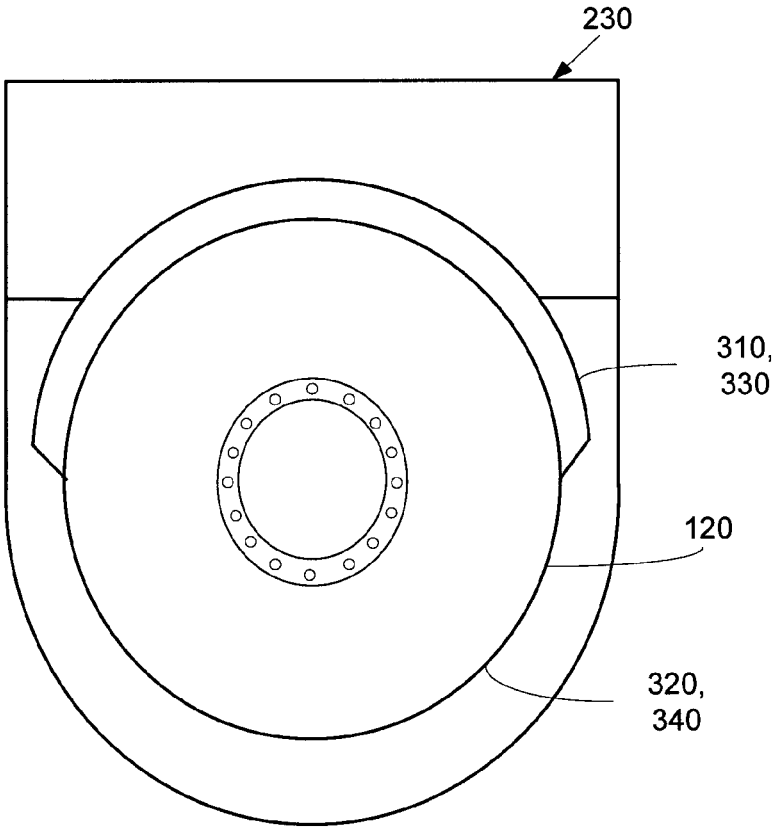
FIG. 6 is a front plan view of the radial diffuser exhaust system of FIG. 4.

FIGS. 4-6 show an example of a further embodiment of a radial diffuser exhaust system 300. The radial diffuser exhaust system 300 also may include the radial diffuser 110 positioned within the asymmetric exhaust collector 240 as is described above. In this example, the outer diffuser guide 130 may include an upper deflector lip 310 positioned about the exhaust end chamber 260 and a lower deflector lip 320 positioned about the closed end chamber 250. Although the upper deflector lip 310 and the lower deflector lip 320 are shown as extending equally about one hundred eighty degrees (180°) along the radial guide section 160, the respective angles may vary. The angles may vary depending upon the design of the radial guide section 160, the exhaust stack, the engine flow rate, and other types of operational parameters. Other components and other configurations also may be used herein.

The upper deflector lip 310 may have a slanted configuration 330 extending upward towards the exhaust end chamber 260 in a downstream direction. The slanted configuration 330 allows for the combustion gases 35 to flow upwards into the exhaust end chamber 260 and towards the exhaust stack. The slanted configuration 330 of the upper deflector lip 310 may guide the recirculation flow into the main stream while avoiding creation of a larger total pressure drop. The slanted configuration 330 of the upper deflector lip 310 helps to eliminate recirculation bubbles within the exhaust end chamber 260 while reducing overall flow separation. The upper deflector lip 310 also provides additional space for the combustion gas flow 35 to expand.

The lower deflector lip 320 may have a largely flat or a different configuration 340 as compared to the slanted configuration 330 of the upper deflector lip 310. The different configuration 340 of the lower deflector lip 320 further inhibits the formation of recirculation vortices about the closed end chamber 250 and contributes to breaking down any vortices therein. The lower deflector lip 20 thus prevents interaction between the strong recirculating flow generated therein and the incoming flow. Specifically, the lower deflector lip 320 helps to evacuate the flow therein without interference with the incoming flow.

The size, shape, angle, and circumferential length of the guide lips may be dictated by the specific thermodynamics of the gas turbine package as a whole as well as the dimensions of the exhaust collector and other components. The width and shape of the guide lips may be independent form one another and may vary along the circumferential locations. A V-profile trim as viewed from the side of the guide lips may favor the motion of the combustion gases from the closed end of the exhaust collector to the open end.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A radial diffuser exhaust system for use with a gas turbine engine, comprising:

a radial diffuser comprising a longitudinal axis, an inner diffuser guide positioned about the longitudinal axis, an outer diffuser guide positioned about the longitudinal axis, and a plurality of support struts positioned between the inner diffuser guide and the outer diffuser guide;

the outer diffuser guide comprising an upstream portion having a conical shape and expanding in a downstream direction and a downstream portion having a conical shape and expanding in the downstream direction, wherein the upstream portion comprises an upstream acute expansion angle relative to the longitudinal axis of the radial diffuser, wherein the downstream portion comprises a downstream acute expansion angle relative to the longitudinal axis of the radial diffuser, wherein the upstream acute expansion angle is larger than the downstream acute expansion angle, wherein the upstream portion and the downstream portion are adjacent one another, and wherein an interface between the upstream portion and the downstream portion is positioned at leading edges of the plurality of support struts; and an exhaust collector positioned asymmetrically about the radial diffuser.

2. A radial diffuser exhaust system for use with a gas turbine engine, comprising:

a radial diffuser comprising a longitudinal axis, an outer diffuser guide positioned about the longitudinal axis, and a plurality of support struts extending from the outer diffuser guide;

the outer diffuser guide comprising an upstream portion having a conical shape and expanding in a downstream direction and a downstream portion having a conical shape and expanding in the downstream direction, wherein the upstream portion comprises an upstream acute expansion angle relative to the longitudinal axis of the radial diffuser, wherein the downstream portion comprises a downstream acute expansion angle relative to the longitudinal axis of the radial diffuser, wherein the upstream acute expansion angle is larger than the downstream acute expansion angle, wherein the upstream portion and the downstream portion are adjacent one another, and wherein an interface between the upstream portion and the downstream portion is positioned at leading edges of the plurality of support struts; and an asymmetric exhaust collector positioned asymmetrically about the radial diffuser.

3. The radial diffuser exhaust system of claim 2, wherein the asymmetric exhaust collector comprises a closed end chamber and an exhaust end chamber, wherein the closed end chamber comprises a first maximum axial length, wherein the exhaust end chamber comprises a second maximum axial length, and wherein the first maximum axial length is smaller than the second maximum axial length.

4. The radial diffuser exhaust system of claim 2, wherein the outer diffuser guide further comprises a radial guide portion having a bellmouth shape and positioned downstream of and adjacent the downstream portion.

5. The radial diffuser exhaust system of claim 2, wherein the asymmetric exhaust collector comprises a closed end chamber and an exhaust end chamber, wherein the outer diffuser guide further comprises a first deflector lip positioned within the exhaust end chamber, and wherein the first deflector lip extends at a first angle relative to the longitudinal axis of the radial diffuser.

6. The radial diffuser exhaust system of claim 5, wherein the outer diffuser guide further comprises a second deflector lip positioned within the closed end chamber.

7. The radial diffuser exhaust system of claim 6, wherein the second deflector lip extends generally parallel to the longitudinal axis of the radial diffuser.

* * * * *